US010208483B1

(12) United States Patent
Wynnyk et al.

(10) Patent No.: US 10,208,483 B1
(45) Date of Patent: Feb. 19, 2019

(54) FAçADES OF MODULAR UNITS AND METHODS OF CONSTRUCTION THEREOF

(71) Applicant: SkyStone Group LLC, New York, NY (US)

(72) Inventors: Andrew Wynnyk, New York, NY (US); Jack Dooley, New York, NY (US); Scott Hill, New York, NY (US)

(73) Assignee: Skystone Group LLC, New York, NY (US)

( * ) Notice: Subject to any disclaimer, the term of this patent is extended or adjusted under 35 U.S.C. 154(b) by 0 days.

(21) Appl. No.: 15/867,809

(22) Filed: Jan. 11, 2018

Related U.S. Application Data

(60) Provisional application No. 62/539,665, filed on Aug. 1, 2017.

(51) Int. Cl.

| | |
|---|---|
| ***E04B 2/96*** | (2006.01) |
| ***E04B 2/88*** | (2006.01) |
| ***E04F 13/08*** | (2006.01) |
| ***E04B 2/90*** | (2006.01) |

(52) U.S. Cl.
CPC ..... *E04F 13/0803* (2013.01); *E04B 2/88* (2013.01); *E04B 2/885* (2013.01); *E04B 2/90* (2013.01); *E04B 2/965* (2013.01); *E04B 2/967* (2013.01); *E04B 2/96* (2013.01)

(58) Field of Classification Search
CPC ..... E04F 13/0803; E04B 2/96; E04B 2/965; E04B 2/967; E04B 2/88; E04B 2/885; E04B 2/90
See application file for complete search history.

(56) References Cited

U.S. PATENT DOCUMENTS

| | | | | |
|---|---|---|---|---|
| 2,017,832 A | | 10/1935 | Hovey | |
| 3,182,766 A | * | 5/1965 | Ferrell | E04B 2/965 52/235 |
| 3,564,795 A | | 2/1971 | Henton | |
| 5,065,557 A | * | 11/1991 | Laplante | E04B 2/96 52/235 |

(Continued)

FOREIGN PATENT DOCUMENTS

| | | | | |
|---|---|---|---|---|
| CN | 206052962 U | | 3/2017 | |
| DE | 2848810 A1 | * | 5/1980 | E04B 2/967 |

(Continued)

OTHER PUBLICATIONS

Patrick Sisson, "Massive Modular Dorm Build Like 'Scaled-up Lego Bricks'". Jun. 14, 2017; (https://www.curbed.com/2017/6/14/15800350/london-modular-dorm-prefab) 2 pages.

*Primary Examiner* — Adriana Figueroa
*Assistant Examiner* — Jessie T Fonseca
(74) *Attorney, Agent, or Firm* — Carter, Deluca, Farrell & Schmidt, LLP

(57) ABSTRACT

A modular system includes a first pair of modular units and a second pair of modular units to be disposed above the first pair of modular units. The first pair of modular units includes brackets configured to be coupled to a façade trim. The second pair of modular units includes brackets configured to be coupled to a façade trim. The brackets of the first pair of modular units are spaced apart from one another a different distance than the brackets of the second pair of modular units are spaced apart from one another.

20 Claims, 3 Drawing Sheets

(56) References Cited

U.S. PATENT DOCUMENTS

| | | | | |
|---|---|---|---|---|
| 5,205,091 | A | 4/1993 | Brown | |
| 5,355,645 | A * | 10/1994 | Farag | E04B 2/96 52/235 |
| 5,381,637 | A * | 1/1995 | Farag | E06B 3/5427 52/204.593 |
| 5,579,616 | A * | 12/1996 | Farag | E04B 2/96 52/204.5 |
| 5,893,245 | A | 4/1999 | Sekiguchi et al. | |
| 7,043,884 | B2 | 5/2006 | Moreno | |
| 7,096,629 | B1 | 8/2006 | Cox | |
| 7,841,147 | B2 | 11/2010 | Moran | |
| 8,417,488 | B2 | 4/2013 | Klipfel, III | |
| 8,919,062 | B1 | 12/2014 | Viness et al. | |
| 9,140,018 | B2 | 9/2015 | Southwell | |
| 9,518,401 | B2 | 12/2016 | Wang | |
| 9,606,701 | B1 | 3/2017 | Jacobs, II et al. | |
| 2003/0226324 | A1* | 12/2003 | Hogan | E04B 2/96 52/235 |
| 2004/0074173 | A1 | 4/2004 | Miller | |
| 2006/0196132 | A1 | 9/2006 | Ruano | |
| 2009/0199498 | A1* | 8/2009 | Ting | E04B 2/90 52/235 |
| 2011/0030288 | A1 | 2/2011 | Traulsen et al. | |
| 2011/0041435 | A1 | 2/2011 | Tragant Ruano et al. | |
| 2011/0167743 | A1* | 7/2011 | Ting | E04B 2/96 52/235 |
| 2012/0304563 | A1 | 12/2012 | Hou et al. | |
| 2013/0305629 | A1 | 11/2013 | Stephenson et al. | |
| 2014/0237921 | A1* | 8/2014 | Ting | E04B 2/88 52/235 |
| 2015/0104578 | A1 | 4/2015 | Spires | |
| 2015/0234377 | A1 | 8/2015 | Mizikovsky | |
| 2017/0260744 | A1* | 9/2017 | Evensen | E04B 2/885 |
| 2017/0298621 | A1* | 10/2017 | Frederick | E04B 2/967 |

FOREIGN PATENT DOCUMENTS

| | | | | |
|---|---|---|---|---|
| DE | 3632764 | A1 * | 4/1987 | E04B 2/967 |
| DE | 10306732 | A1 * | 9/2004 | E04B 2/96 |
| DE | 102006036842 | A1 * | 2/2008 | E04B 2/90 |
| EP | 1524378 | A2 * | 4/2005 | E04B 2/96 |
| EP | 2472021 | A1 * | 7/2012 | E04B 2/90 |
| FR | 2314326 | A1 * | 1/1977 | E04B 2/96 |
| JP | 2002245114 | A | 8/2002 | |
| JP | 2011185002 | A * | 9/2011 | E04B 2/90 |
| WO | 2005114495 | A1 | 12/2005 | |

* cited by examiner

FAçADES OF MODULAR UNITS AND METHODS OF CONSTRUCTION THEREOF

CROSS-REFERENCE TO RELATED APPLICATION

This application claims the benefit of and priority to U.S. Provisional Application No. 62/539,665, filed on Aug. 1, 2017, the entire contents of which are incorporated by reference herein.

BACKGROUND

Technical Field

The present disclosure relates generally to modular buildings. More particularly, the present disclosure relates to façades of modular units and methods of varying the design of façades of modular units.

Background of Related Art

Modular units are commonly used for constructing residential and industrial structures because they can be partially assembled/constructed remote from the building site and transported to the building site for assembly into a complete building structure. Typically in modular construction, glazing and glazing treatment are assembled to the modular unit off-site and delivered to the construction site as an integral unit. Due to the identical nature of modular units, the glazing and treatment also appear identical, giving the façade an overall simplistic, prefabricated aesthetic.

Accordingly, it would be advantageous to provide modular units that allow for greater flexibility in designing a façade having a more irregular, non-conventional appearance.

SUMMARY

In one aspect of the present disclosure, a modular system is provided and includes a first pair of modular units to be disposed in a side-by-side orientation, and a second pair of modular units to be disposed in a side-by-side orientation and above or below the first pair of modular units. Each of the first pair of modular units includes a first modular frame and a first bracket. The first modular frame of each of the first modular units has a first front surface and a first lateral surface. The first brackets are disposed on the first front surface adjacent the first lateral surface. The first brackets are configured to be coupled to a façade trim and are spaced apart from one another a first distance. Each of the second pair of modular units includes a second modular frame and a second bracket. The second modular frame of each of the second modular units has a second front surface and a second lateral surface. The second brackets are disposed on the second front surface adjacent the second lateral surface and are configured to be coupled to a façade trim. The second brackets are spaced apart from one another a second distance, different than the first distance.

In embodiments, the first distance may be greater than the second distance.

In embodiments, the first and second distances may correspond to widths of a respective first and second façade trims.

In embodiments, the first façade trim may include first and second sections. The first section may be coupled to and extends outwardly from the first bracket of a first modular unit of the first pair of modular units. The second section may be coupled to and extend outwardly from the first bracket of a second modular unit of the first pair of modular units.

In embodiments, the second façade trim may include a first section and a second section. The first section may be coupled to and extend outwardly from the second bracket of a first modular unit of the second pair of modular units. The second section may be coupled to and extend outwardly from the second bracket of a second modular unit of the second pair of modular units.

In embodiments, the first pair of modular units may define a first mateline between the first lateral surfaces, and the second pair of modular units may define a second mateline between the second lateral surfaces. The first and second matelines may be aligned along a vertical plane when the first and second pairs of modular units are vertically stacked.

In embodiments, the first and second façade trims may be aligned along the vertical plane.

In embodiments, the first bracket of a first modular unit of the first pair of modular units may be configured to be coupled to a first curtain wall, and the first bracket of a second modular unit of the first pair of modular units may be configured to be coupled to a second curtain wall. The first and second curtain walls may be spaced apart from one another a third distance. The second bracket of a first modular unit of the second pair of modular units may be configured to be coupled to a third curtain wall, and the second bracket of a second modular unit of the second pair of modular units may be configured to be coupled to a fourth curtain wall. The third and fourth curtain walls may be spaced apart from one another a fourth distance, different than the third distance.

In embodiments, the first bracket of each of the first pair of modular units may have an L-shaped configuration.

In embodiments, the first bracket of each of the first pair of modular units may include a first portion extending along the first front surface, and a second portion extending perpendicularly from the first portion. The second bracket of each of the second pair of modular units may include a first portion extending along the second front surface, and a second portion extending perpendicularly from the first portion of the second bracket. The second portion of the first bracket may be longer than the second portion of the second bracket.

In another aspect of the present disclosure, a method of constructing a modular building is provided. The method includes providing the first and second pair of modular units, coupling a first façade trim to the first modular frame of each of the first pair of modular units via the first brackets, and coupling a second façade trim to the second modular frame of each of the second pair of modular units via the second brackets.

Some methods may further include vertically stacking the first pair of modular units on the second pair of modular units.

In some methods, vertically stacking may include aligning the first and second façade trims along a vertical plane.

Some methods may further include positioning the first pair of modular units in a side-by-side orientation, and positioning the second pair of modular units in a side-by-side orientation.

In some methods, the first and second distances may correspond to widths of the respective first and second façade trims, such that the widths of the first and second façade trims are different.

Some methods may further include coupling a first curtain wall to the first bracket of a first modular unit of the first pair of modular units, and coupling a second curtain wall to the first bracket of a second modular unit of the first pair of modular units, such that the first and second curtain walls are spaced apart from one another a third distance. A third curtain wall may be coupled to the second bracket of a first modular unit of the second pair of modular units, and a fourth curtain wall may be coupled to the second bracket of a second modular unit of the second pair of modular units, such that the third and fourth curtain walls are spaced apart from one another a fourth distance, different than the third distance.

Further details, advantages, and aspects of exemplary embodiments of the present disclosure are described in more detail below with reference to the appended figures.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

As used herein, the term "coupled" means either a direct mechanical connection between the components that are connected, or an indirect mechanical connection through one or more intermediary components.

As used herein, the term "mateline" refers to a central axis along which adjacent modular units are coupled to one another.

As used herein, the terms parallel and perpendicular are understood to include relative configurations that are substantially parallel and substantially perpendicular up to about + or −10 degrees from true parallel and true perpendicular.

BRIEF DESCRIPTION OF THE DRAWINGS

Embodiments of the present disclosure are described herein with reference to the accompanying drawings, wherein.

DETAILED DESCRIPTION

Figure 1:
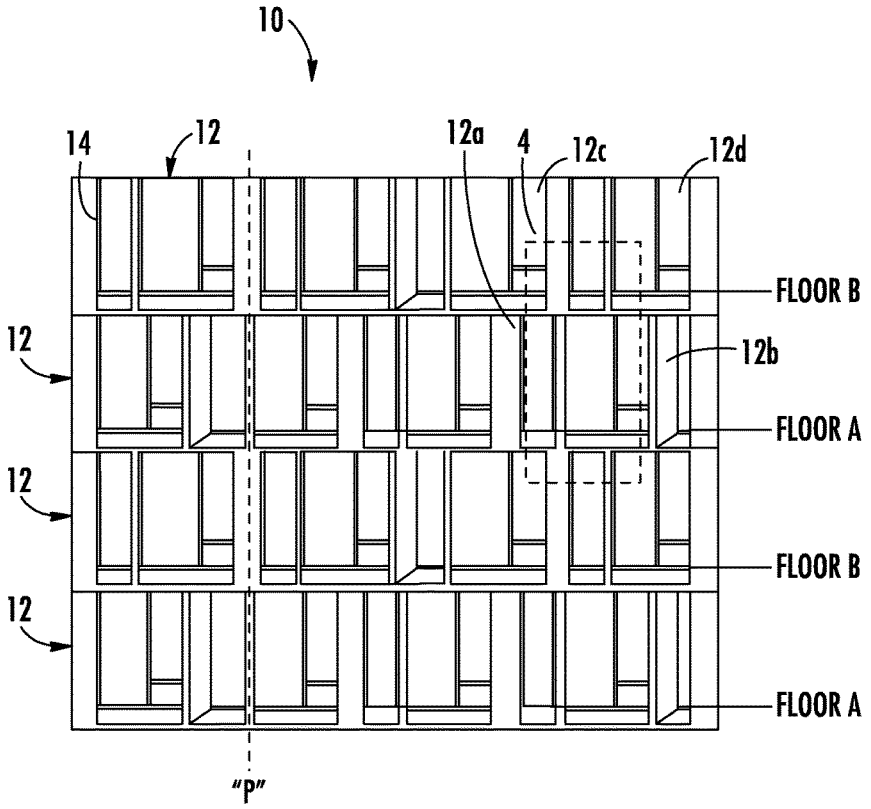
FIG. 1 is a front view of an embodiment of a modular building, illustrating an alternating façade pattern between floors.

Embodiments of the presently disclosed modular buildings and methods of construction are described in detail with reference to the drawings, in which like reference numerals designate identical or corresponding elements in each of the several views.

The present disclosure provides modular units that allow for the attachment of a variety of façade trims. Adjacent modular units of a first floor are disposed side-by-side, and adjacent modular units of a second floor are disposed side-by-side and above the modular units of the first floor. The adjacent modular units of each of the first and second floors have a connector for coupling to a unique façade trim. The connector of the adjacent modular units of the first floor defines a first horizontal gap, and the connector of the adjacent modular units of the second floor defines a second horizontal gap, that is greater in width than the first horizontal gap. Accordingly, the connectors of the first and second floors are configured to accommodate uniquely dimensioned façade trims. Due to the connectors allowing for the connection of uniquely dimensioned façade trims, the modular building assumes a less modular appearance. These and other features of the disclosed modular assemblies and their construction will be described in further detail herein.

Referring initially to FIG. 1, a modular building generally designated by reference numeral 10 is provided. The modular building 10 has a plurality of floors or levels made up of a plurality of prefabricated modular units 12. The modular units 12 of a given floor are oriented in a side-by-side orientation and are stacked on modular units of a floor below. Two or more floors of the modular building 10 have discretely designed façades. In particular, the modular building 10 may include two repeating floors "A" and "B" each having a distinct façade pattern that extends along their respective horizontal axes. In embodiments, the distinct façade pattern of floors "A" and "B" may alternate from floor to floor along the height of the modular building 10, thereby giving the façade or cladding 14 of the modular building 10 an overall non-uniform, non-modular appearance. In other embodiments, the modular building 10 may include more than two distinct façade patterns.

Figure 2A:
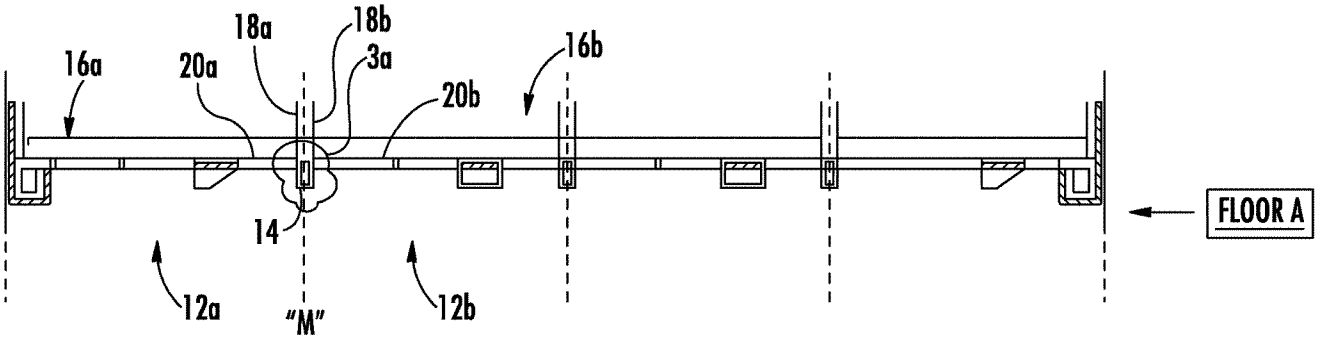
FIG. 2A is a plan view of a front section of a first floor of the modular building of FIG. 1.
Figure 2B:
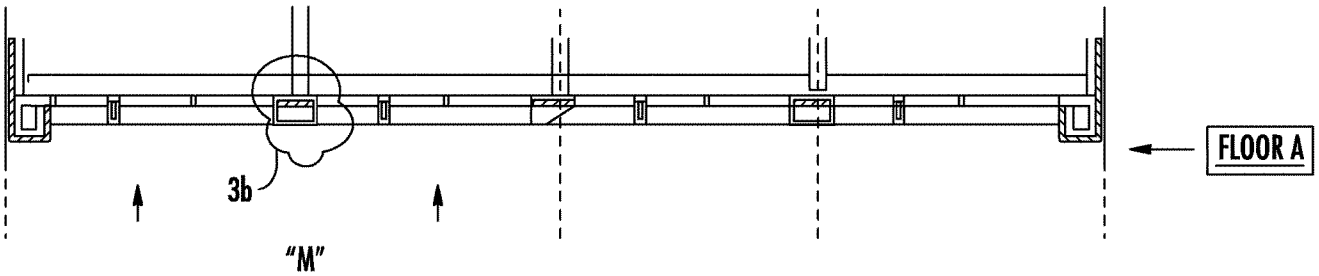
FIG. 2B is a plan view of a front section of a second floor of the modular building of FIG. 1.

With reference to FIGS. 2A and 2B, the façade pattern of floors "A" and "B" is created by units of discretely designed façade trim 14, 24 individually coupled to the modular units 12 of each floor. As will be described in further detail below, adjacent modular units 12 of a given floor have a coupling mechanism distinctly sized for attachment of a correspondingly sized façade trim. Due to the distinctly sized coupling mechanisms on each floor, the size and/or design of the façade trim 14 that is associated with one floor, for example, floor "A," may be different from the size and/or design of the façade trim 24 that is associated with another floor, for example, floor "B."

Figure 3A:
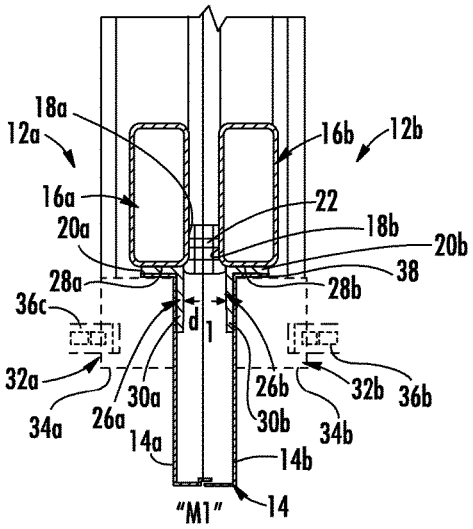
FIG. 3A is an enlarged view of the area of detail designated "3A" in FIG. 2A, illustrating a first façade trim coupled to a first pair of modular units of the first floor of the modular building of FIG. 1.

With reference to FIGS. 2A and 3A, in the first floor "A" of the modular building 10, adjacent first and second modular units 12*a*, 12*b* are coupled to one another along a mateline "M1" to form a first pair of modular units. Each of the first pair of modular units 12*a*, 12*b* includes a modular frame 16*a*, 16*b* having a lateral surface 18*a*, 18*b* and a front surface 20*a*, 20*b*. The first and second modular frames 16*a*, 16*b* have a generally rectangular shape, but it is contemplated that the first and second modular frames 16*a*, 16*b* may assume any suitable shape, such as, for example, square, triangular, or the like. The adjacent lateral surfaces 18*a*, 18*b* of the first and second modular frames 16*a*, 16*b* are parallel to one another and spaced a selected distance from one another to define a horizontal gap therebetween. A portion of the horizontal gap may be filled with a firestop material 22. In other embodiments, the adjacent lateral surfaces 18*a*, 18*b* of the first and second modular frames 16*a*, 16*b* may abut one another.

The first pair of modular units 12*a*, 12*b* respectively include first and second connectors, such as, for example, first and second brackets 26*a*, 26*b*. The first bracket 26*a* is coupled to the front surface 20*a* of the first modular frame 16*a*, and the second bracket 26*b* is coupled to the front surface 20*b* of the second modular frame 16*b*. Each of the brackets 26*a*, 26*b* has a respective first portion 28*a*, 28*b* and a second portion 30*a*, 30*b* extending perpendicularly from the first portion 28*a*, 28*b*, such that the brackets 26*a*, 26*b* assume an L-shaped configuration. In embodiments, the brackets 26*a*, 26*b* may assume any suitable configuration, such as, for example, v-shaped, I-shaped, or linear.

The first portion 28*a* of the first bracket 26*a* is attached to and extends horizontally along the front surface 20*a* of the first modular frame 16*a* at a location adjacent the lateral surface 18*a* of the first modular frame 16*a*. Similarly, the first portion 28*b* of the second bracket 26*b* is attached to and extends horizontally along the front surface 20*b* of the second modular frame 16*b* at a location adjacent the lateral surface 18*b* of the second modular frame 16*b*. The first portions 28*a*, 28*b* of the first and second brackets 26*a*, 26*b* are horizontally aligned. The second portion 30*a* of the first bracket 26*a* is configured to be coupled to both a first curtain wall 32*a* and a first section 14*a* of the first façade trim 14, and the second portion 30*b* of the second bracket 26*b* is configured to be coupled to both a second curtain wall 32*b* and a second section 14*b* of the first façade trim 14. The second portions 30*a*, 30*b* of the first and second brackets 26*a*, 26*b* are spaced horizontally from one another a first distance "$d_1$" to provide a space to accommodate the first façade trim 14.

The first and second sections 14*a*, 14*b* of the first façade trim 14 are attached to the respective second portions 30*a*, 30*b* of the brackets 26*a*, 26*b*, and extend outwardly (e.g., perpendicularly) relative to the front surface 20*a*, 20*b* of the first and second modular frames 16*a*, 16*b*. Due to the horizontal spacing between the brackets 26*a*, 26*b*, the first façade trim 14 assumes a width that is substantially equivalent to the first distance "$d_1$." As will be described in further detail below, the width of the first façade trim 14, which is to be located on the first floor "A," is different (e.g., smaller) than that of the second façade trim 24, which is to be located on the second floor "B," thereby giving the modular building 10 a non-uniform appearance.

Each of the first and second modular units 12*a*, 12*b* further includes a curtain wall 32*a*, 32*b* attached to the respective first and second brackets 26*a*, 26*b*. The curtain walls 32*a*, 32*b* each include a mullion or vertical beam 34*a*, 34*b* attached to the second portion 30*a*, 30*b* of the respective bracket 26*a*, 26*b*, and glazing 36*a*, 36*b* extending from the mullion 34*a*, 34*b*. One or both of the curtain walls 32*a*, 23*b* may include a thermal break 38 disposed between the mullion 34*b* and the bracket 26*b* to decrease the thermal conductivity of the curtain walls 32*a*, 32*b*. The curtain walls 32*a*, 32*b* are horizontally spaced from one another due to the horizontal spacing between the brackets 26*a*, 26*b*.

Figure 3B:
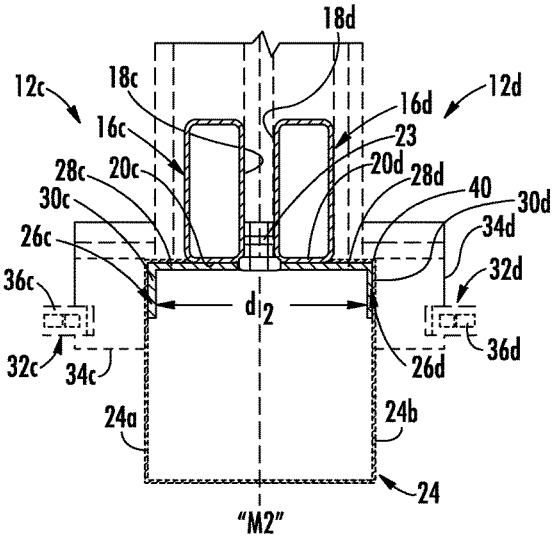
FIG. 3B is an enlarged view of the area of detail designated "3B" in FIG. 2B, illustrating a second façade trim coupled to a second pair of modular units of the second floor of the modular building of FIG. 1.
Figure 4:
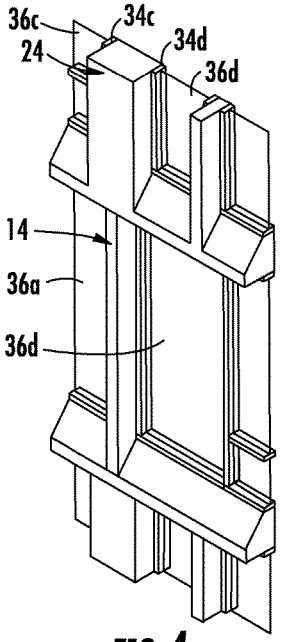
FIG. 4 is a perspective view of a section designed "4" in FIG. 1 of the façade of the modular building.

With reference to FIGS. 2B and 3B, in the second floor "B" of the modular building 10, adjacent third and fourth modular units 12*c*, 12*d* are coupled to one another along a second mateline "M2" to form a second pair of modular units 12*c*, 12*d*. The mateline "M2" of the second pair of modular units 12*c*, 12*d* of the second floor "B" is aligned with the mateline "M1" of the first pair of modular units 12*a*, 12*b* of the first floor "A" along a vertical plane. The second pair of modular units 12*c*, 12*d* includes respective first and second modular frames 16*c*, 16*d* having a lateral surface 18*c*, 18*d* and a front surface 20*c*, 20*d*. The first and second modular frames 16*c*, 16*d* have a generally rectangular shape, but it is contemplated that the modular frames 16*c*, 16*d* may assume any suitable shape, such as, for example, square, triangular, or the like. The lateral surfaces 18*c*, 18*d* of adjacent first and second modular frames 16*c*, 16*d* are parallel to one another and spaced a selected distance from one another to define a horizontal gap therebetween. A portion of the horizontal gap may be filled with a firestop material 23.

The third modular unit 12*c* has a third connector, such as, for example, a third bracket 26*c*, coupled to the front surface 20*c* of the modular frame 16*c* thereof, and the fourth modular unit 12*d* has a fourth connector, such as, for example, a fourth bracket 26*d*, coupled to the front surface 20*d* of the modular frame 16*d* thereof. Each of the brackets 26*c*, 26*d* has a respective first portion 28*c*, 28*d* and a second portion 30*c*, 30*d* extending perpendicularly from the first portion 20*c*, 20*d*, such that the 26*c*, 26*d* brackets assume an L-shaped configuration. In embodiments, the brackets 26*c*, 26*d* may assume any suitable configuration, such as, for example, v-shaped, I-shaped, or linear.

The first portion 28*c* of the third bracket 26*c* is attached to and extends horizontally along the front surface 20*c* of the third modular frame 16*c* at a location adjacent the lateral surface 18*c* of the third modular frame 16*c*. Similarly, the first portion 28*d* of the third bracket 26*d* is attached to and extends horizontally along the front surface 20*d* of the fourth modular frame 16*d* at a location adjacent the lateral surface 18*d* of the fourth modular frame 16*d*. The first portions 28*c*, 28*d* of the third and fourth brackets 26*c*, 26*d* are horizontally aligned. The first portion 28*c*, 28*d* of each of the third and fourth brackets 26*c*, 26*d* has a length that is greater than the length of the first portion 28*a*, 28*d* of each of the first and second brackets 26*a*, 26*b*, respectively. In embodiments, the first portion 28*c*, 28*d* of the third and fourth brackets 26*c*, 26*d* may be approximately two or more times the length of the first portion 28*a*, 28*b* of the first and second brackets 26*a*, 26*b*. In embodiments, the third and fourth brackets 26*c*, 26*d* may be substantially similar to the first and second brackets 26*a*, 26*b*, except for being rotationally offset approximately 90 degrees.

The second portion 30*c* of the third bracket 26*c* is configured to be coupled to both a third curtain wall 32*c* and a first section 24*a* of the second façade trim 24, and the second portion 30*d* of the fourth bracket 26*d* is configured to be coupled to both a fourth curtain wall 32*d* and a second section 24*b* of the second façade trim 24. The second portions 30*c*, 30*d* of the third and fourth brackets 26*c*, 26*d* are spaced horizontally from one another a second distance "$d_2$" to provide a space for accommodating the second façade trim 24. The second distance "$d_2$" of the spacing between the third and fourth brackets 26*c*, 26*d* is different than the spacing between the first and second brackets 26*a*, 26*b*. Specifically, the second distance "$d_2$" may be greater than the first distance "$d_1$," such that the second pair of modular units 12*c*, 12*d* can accommodate a wider façade trim than the first pair of modular units 12*a*, 12*b*.

The first and second sections 24*a*, 24*b* of the second façade trim 24 are attached to the second portions 30*c*, 30*d* of the third and fourth brackets 26*c*, 26*d*, and extend outwardly (e.g., perpendicularly) relative to the front surface 20*c*, 20*d* of the third and fourth modular frames 16*c*, 16*d*. Due to the horizontal spacing between the brackets 26*c*, 26*d*, the second façade trim 24 assumes a width that is substantially equivalent to the second distance "$d_2$." The width of the second façade trim 24 of the second floor "B" is different (e.g., larger) than that of the first façade trim 14 of the first floor "A." The first and second façade trims 14, 24 of the respective first and second floors "A," "B" are aligned along a vertical plane so that when viewing the modular building 10, it is readily apparent that the façade trims 14, 24 of the first and second floors "A," "B" are non-uniform.

The second pair of modular units 12*c*, 12*d* further includes respective third and fourth curtain walls 32*c*, 32*d* attached to the respective third and fourth brackets 26*c*, 26*d*. The curtain walls 32*c*, 32*d* each include a mullion or vertical beam 34*c*, 34*d* attached to the second portion 30*c*, 30*d* of the respective bracket 26*c*, 26*d*, and glazing 36*c*, 36*d* extending from the mullion 34*c*, 34*d*. One or both of the curtain walls 32*c*, 32*d* may include a thermal break 40 disposed between the mullion 34*d* and the bracket 26*d* to decrease the thermal conductivity of the curtain wall 32*d*. The horizontal spacing between the third and fourth brackets 26*c*, 26*d* results in a horizontal spacing between the third and fourth curtain walls 32*c*, 32*d*. Due to the second distance "d2" between the third and fourth brackets 26*c*, 26*d* being greater than the first distance "d1" between the first and second brackets 26*a*, 26*b*, the curtain walls 32*c*, 32*d* of the second pair of modular units 12*c*, 12*d* of the second floor "B" are horizontally spaced from one another a greater distance than the curtain walls 32*a*, 32*b* of the first pair of modular units 12*a*, 12*b* of the first floor "A."

A method of constructing an alternating façade of a modular building 10 will now be described. A suitable number of modular units 12*a*, 12*b*, 12*c*, 12*d* are fabricated at an off-site facility and then delivered to the construction site as integral units consisting of the modular frame 16*a*, the first section 14*a* of the façade trim 14, and the curtain wall 32*a*. The number of modular units 12 manufactured for construction of the first and second floors "A," "B" is selected based on the desired width of the modular building 10.

To construct the first floor "A" of the modular building 10, the first pair of modular units 12*a*, 12*b* is first manufactured at an off-site facility. To install the first pair of modular units 12*a*, 12*b*, the first section 14*a* of the first façade trim 14 is coupled to the first modular frame 16*a* via the first bracket 26*a*, and the second section 14*b* of the first façade trim 14 is coupled to the second modular frame 16*b* via the second bracket 26*b*. The first curtain wall 32*a* is positioned on the front surface 20 of the first modular frame 16*a* and coupled to the first bracket 26*a* and the first section 14*a* of the first façade trim 14. The second curtain wall 32*b* is positioned on the front surface 20*b* of the second modular frame 16*b* and coupled to the second bracket 26*b* and the second section 14*b* of the first façade trim 14.

To construct the second floor "B" of the modular building 10, the second pair of modular units 12*c*, 12*d* is first manufactured at an off-site facility. To install the second pair of modular units 12*c*, 12*d*, the first section 24*c* of the second façade trim 24 is coupled to the third modular frame 16*c* via the third bracket 26*c*, and the second section 24*b* of the second façade trim 24 is coupled to the fourth modular frame 16*d* via the fourth bracket 26*d*. The third curtain wall 32*c* is positioned on the front surface 20*c* of the third modular frame 16*c* and coupled to the third bracket 26*c* and the first section 24*a* of the second façade trim 24. The fourth curtain wall 32*d* is positioned on the front surface 20*d* of the fourth modular frame 16*d* and coupled to the fourth bracket 26*d* and the second section 24*b* of the second façade trim 24.

In some methods, the façade trims 14, 24 and/or the curtain walls 32*a-d* may be delivered to the construction site in a disassembled state from the modular frames 16*a-d* and be coupled to the modular frames 16*a-d* at the construction site.

At a construction site, the first pair of modular units 12*a*, 12*b* is positioned in a side-by-side orientation, such that their respective lateral surfaces 18*a*, 18*b* are adjacent one another, thereby forming a portion of the first floor "A." The first and second sections 14*a*, 14*b* of the first façade trim 14 are fitted to one another along the mateline "M1." The second pair of modular units 12*c*, 12*d* is positioned in a side-by-side orientation, such that their respective lateral surfaces 18*c*, 18*d* are adjacent one another, thereby forming a portion of the second floor "B." The second pair of modular units 12*c*, 12*b* is vertically stacked on top of the first pair of modular units 12*a*, 12*b*, so that the first and second façade trims 14, 24 are aligned along a vertical plane that extends through each of the matelines "M1," "M2" of the first and second floors "A," "B." Due to the first and second façade trims 14, 24 having different widths, when viewing the modular building 10, the first and second floors "A," "B" appear non-uniform and non-modular. As shown in the illustrated embodiment, additional floors may be added to the modular building 10 by alternating between façade patterns of floors "A" and "B" so that the façade of the modular building 10 is non-uniform along its entire height.

It will be understood that various modifications may be made to the embodiments and methods disclosed herein. Therefore, the above description should not be construed as limiting, but merely as exemplifications of various embodiments and methods. Those skilled in the art will envision other modifications within the scope and spirit of the claims appended thereto.

What is claimed is:

1. A modular system comprising:

a first pair of modular units to be disposed in a side-by-side orientation, each of the first pair of modular units including:

a first modular frame having a first front surface and a first lateral surface; and a first bracket disposed on and in front of the first front surface adjacent the first lateral surface, the first brackets configured to be coupled to a first façade trim, wherein the first brackets are spaced apart from one another a first distance; and a second pair of modular units to be disposed in a side-by-side orientation and above or below the first pair of modular units, each of the second pair of modular units including:

a second modular frame having a second front surface and a second lateral surface; and a second bracket disposed on and in front of the second front surface adjacent the second lateral surface, the second brackets configured to be coupled to a second façade trim, wherein the second brackets are spaced apart from one another a second distance, different than the first distance.

2. The modular system according to claim 1, wherein the first distance is greater than the second distance.

3. The modular system according to claim 1, wherein the first and second distances correspond to widths of the respective first and second façade trims.

4. The modular system according to claim 3, wherein the first façade trim includes:

a first section coupled to and extending outwardly from the first bracket of a first modular unit of the first pair of modular units; and a second section coupled to and extending outwardly from the first bracket of a second modular unit of the first pair of modular units.

5. The modular system according to claim 4, wherein the second façade trim includes:

a first section coupled to and extending outwardly from the second bracket of a first modular unit of the second pair of modular units; and a second section coupled to and extending outwardly from the second bracket of a second modular unit of the second pair of modular units.

6. The modular system according to claim 3, wherein the first pair of modular units define a first mateline between the first lateral surfaces, and the second pair of modular units define a second mateline between the second lateral surfaces, the first and second matelines being aligned along a vertical plane when the first and second pairs of modular units are vertically stacked.

7. The modular system according to claim 6, wherein the first and second façade trims are aligned along the vertical plane.

8. The modular system according to claim 1, wherein the first bracket of a first modular unit of the first pair of modular units is configured to be coupled to a first curtain wall, and the first bracket of a second modular unit of the first pair of modular units is configured to be coupled to a second curtain wall, the first and second curtain walls being spaced apart from one another a third distance.

9. The modular system according to claim 8, wherein the second bracket of a first modular unit of the second pair of modular units is configured to be coupled to a third curtain wall, and the second bracket of a second modular unit of the second pair of modular units is configured to be coupled to a fourth curtain wall, the third and fourth curtain walls being spaced apart from one another a fourth distance, different than the third distance.

10. The modular system according to claim 1, wherein the first bracket of each of the first pair of modular units has an L-shaped configuration.

11. The modular system according to claim 10, wherein the first bracket of each of the first pair of modular units includes:

a first portion extending along the respective first front surface; and a second portion extending perpendicularly from the first portion.

12. The modular system according to claim 11, wherein the second bracket of each of the second pair of modular units includes:

a first portion extending along the respective second front surface; and a second portion extending perpendicularly from the first portion of the second bracket, the second portion of the first bracket being longer than the second portion of the second bracket.

13. A method of constructing a modular building, comprising:

providing a first pair of modular units, each of the first pair of modular units including:

a first modular frame having a first front surface and a first lateral surface; and a first bracket disposed on and in front of the first front surface adjacent the first lateral surface, wherein the first brackets are spaced apart from one another a first distance;

coupling a first façade trim to the first modular frame of each of the first pair of modular units via the first brackets;

providing a second pair of modular units, each of the second pair of modular units including:

a second modular frame having a second front surface and a second lateral surface; and a second bracket disposed on and in front of the second front surface adjacent the second lateral surface, the second brackets being spaced apart from one another a second distance, different than the first distance; and coupling a second façade trim to the second modular frame of each of the second pair of modular units via the second brackets.

14. The method according to claim 13, further comprising vertically stacking the first pair of modular units on the second pair of modular units.

15. The method according to claim 14, wherein vertically stacking includes aligning the first and second façade trims along a vertical plane.

16. The method according to claim 13, further comprising:

positioning the first pair of modular units in a side-by-side orientation; and positioning the second pair of modular units in a side-by-side orientation.

17. The method according to claim 13, wherein the first and second distances correspond to widths of the respective first and second façade trims, such that the widths of the first and second façade trims are different.

18. The method according to claim 13, further comprising:

coupling a first curtain wall to the first bracket of a first modular unit of the first pair of modular units; and coupling a second curtain wall to the first bracket of a second modular unit of the first pair of modular units, such that the first and second curtain walls are spaced apart from one another a third distance.

19. The method according to claim 18, further comprising:

coupling a third curtain wall to the second bracket of a first modular unit of the second pair of modular units; and coupling a fourth curtain wall to the second bracket of a second modular unit of the second pair of modular units, such that the third and fourth curtain walls are spaced apart from one another a fourth distance, different than the third distance.

20. A modular system comprising:

a first pair of modular units to be disposed in a side-by-side orientation, each of the first pair of modular units including:

a first modular frame having a first front surface and a first lateral surface; and a first bracket disposed on the first front surface adjacent the first lateral surface, the first brackets configured to be coupled to a first façade trim, the first brackets being spaced apart from one another a first distance, wherein the first bracket of each of the first pair of modular units has an L-shaped configuration; and a second pair of modular units to be disposed in a side-by-side orientation and above or below the first pair of modular units, each of the second pair of modular units including:

a second modular frame having a second front surface and a second lateral surface; and a second bracket disposed on the second front surface adjacent the second lateral surface, the second brackets configured to be coupled to a second façade trim, wherein the second brackets are spaced apart from one another a second distance, different than the first distance.

* * * * *